United States Patent [19]

Ebner

[11] 4,203,330

[45] May 20, 1980

[54] PHOTOTYPESETTER CARRIAGE DETENT MECHANISM

[75] Inventor: Peter R. Ebner, South Nashua, N.H.

[73] Assignee: Itek Corporation, Lexington, Mass.

[21] Appl. No.: 864,307

[22] Filed: Dec. 27, 1977

[51] Int. Cl.[2] ..... G05G 5/06

[52] U.S. Cl. ..... 74/527; 354/5

[58] Field of Search ..... 74/99, 532, 527, 529, 74/101, 53, 89, 495, 475, 504, 100 R, 100 P; 354/15, 5

[56] References Cited

U.S. PATENT DOCUMENTS

| | | | |
|---|---|---|---|
| 1,929,268 | 10/1933 | Haydon | 74/504 |
| 2,862,722 | 12/1958 | Brueder | 74/495 |
| 3,183,426 | 5/1965 | Bata | 74/100 |

FOREIGN PATENT DOCUMENTS

| | | | |
|---|---|---|---|
| 808407 | 7/1951 | Fed. Rep. of Germany | 74/527 |

*Primary Examiner*—Samuel Scott
*Assistant Examiner*—G. Anderson
*Attorney, Agent, or Firm*—Homer O. Blair; Robert L. Nathans

[57] ABSTRACT

A moveable carriage bearing an optical element, such as a font segment track select mirror, is supported upon a flat elongated plateway by means of rollers mounted upon the carriage which is translated along the plateway so that the carriage assumes only a first or second discrete position after it comes to rest. A single spring is employed to cause first and second detent members to be maintained in firm contact with each other to cause the carriage to assume either a first discrete position or a second discrete position while simultaneously maintaining the carriage mounted rollers in firm contact with the plateway.

11 Claims, 4 Drawing Figures

PHOTOTYPESETTER CARRIAGE DETENT MECHANISM

BACKGROUND OF THE INVENTION

In a phototypesetting machine, it is often desirable to selectively project images of characters along the optical projection axis which are recorded upon a plurality of discrete tracks formed upon a font disc. The selection of a particular track may be effected by providing a selection mirror mounted upon a moveable carriage, which is shifted between first and second discrete accurately defined positions corresponding to the spacial positioning of the character bearing tracks. It is highly desirable to provide a simple, inexpensive, and reliable mechanism for accurately maintaining such moveable carriage firmly against a plateway or track while mechanically biasing first and second detent members together to cause the carriage to assume either the first or the second discrete position.

SUMMARY OF THE INVENTION

In accordance with a preferred embodiment of the present invention, a single spring means is provided for mechanically biasing a first detent roller member rigidly coupled to the moveable carriage against a second detent pin member coupled to the machine frame via a pivotable arm. When the carriage is translated along the plateway from a first discrete position to a second discrete position, the second detent pin member rides up and over the upper arcuate portion of the first roller detent member while being maintained in firm contact therewith by the spring means. Significantly, since the detent pin member is urged at all times against the roller detent member, the carriage is firmly maintained in contact with the plateway.

Other objects, features, and advantages of the present invention will become apparent upon the perusal of the following description taken in conjunction with the drawings in which:

FIG. 1 schematically illustrates a front view of the mechanism of the invention;

FIG. 2 illustrates a side view of the mechanism; and

FIGS. 3 and 4 respectively illustrate the spacial relationship between the detent members when the carriage assumes the left hand and right hand positions.

DETAILED DESCRIPTION

Figure 1:
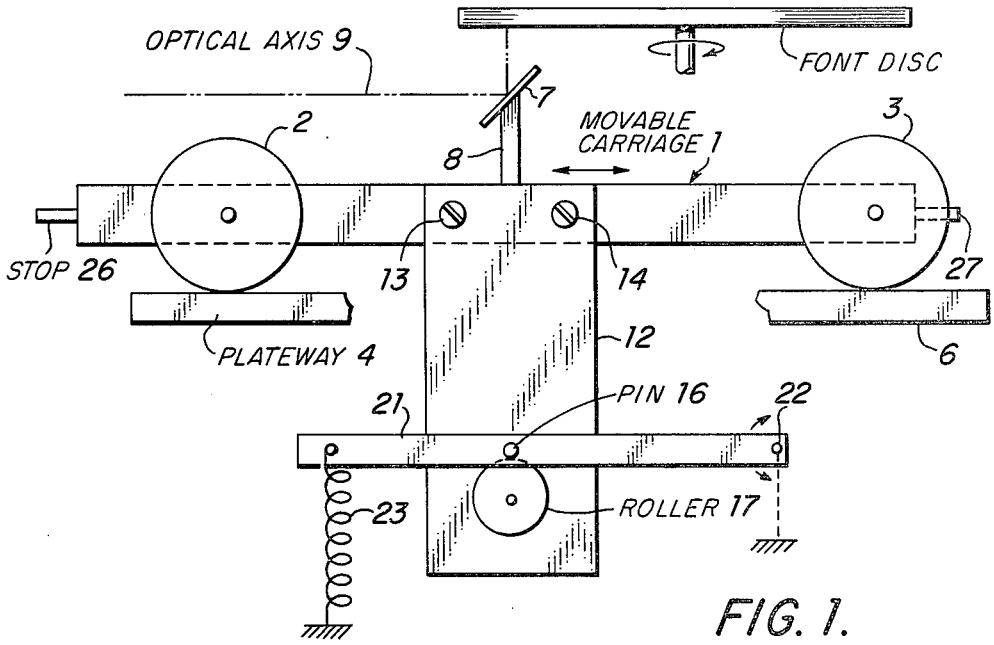
Figure 2:
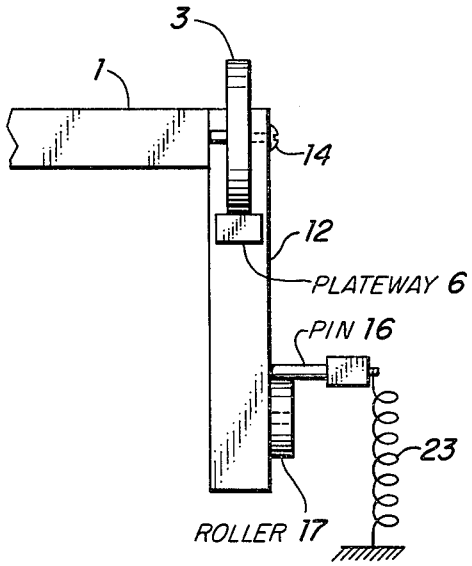

Moveable carriage 1 is illustrated having rollers 2 and 3 mounted thereon for supporting the carriage against an elongated flat plateway, portions 4 and 6 thereof being illustrated in the drawing. A track select mirror 7 is rigidly affixed to carriage 1 by any suitable support member 8 so that when the carriage assumes a first discrete position, characters within a first track are projected along optical axis 9, and characters formed within a second track will be projected along the same optical axis when the carriage shifts to the second discrete position. A detent mechanism is desired to ensure that the carriage cannot assume an intermediate position.

A first detent member support means, such as plate 12, is provided which may be rigidly affixed to carriage 1 by means of, for example, screws 13 and 14. The first detent member comprises roller 17, which is rotatably coupled to member 12, while the second detent member includes pin 16 affixed to arm 21, which is pivotably coupled to the machine frame at portion 22 at a first portion thereof illustrated in FIG. 1. A mechanical biasing means such as a single spring 23 is coupled between a second portion of arm member 21 and the machine frame as illustrated. Adjustable stop screws 26 and 27 are employed to precisely define the aforesaid first and second positions.

Figure 3:
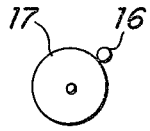
Figure 4:
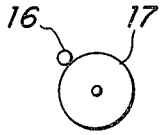

Thus, the present invention advantageously may employ a single mechanical biasing means such as a helical coil spring for maintaining detent members 16 and 17 in firm contact with each other to eliminate the possibility of the carriage coming to rest in an intermediate position between the above-mentioned first and second discrete positions while simultaneously maintaining the carriage firmly seated upon the plateway due to the "pull down" action of pin 16 upon roller 17 and hence upon the carriage. When the carriage assumes the left hand discrete position, pin 16 will bear down against the upper right hand portion of roller detent member 17 as illustrated in FIG. 3. When the carriage is moved to the right, pin 16 will pass over the top arcuate portion of roller 17 to assume the unstable intermediate position illustrated in FIG. 1, and will continue to pass over the roller until the pin assumes the position shown in FIG. 4 where its path of travel will cease owing to the action of stop 27 against a stationary stop member (not shown).

The illustrated structure could, if desired be employed to support the other side of the carriage, or a ballbearing housing, mounted upon a cylindrical way, is preferrably employed as set forth in co-pending application #790,713 filed on Apr. 25, 1977 now U.S. Pat. No. 4,119,976.

While the above-described configuration is greatly preferred, other variations of the invention will be apparent to those skilled in the art. While the use of a rotatable roller is preferred for the first detent member, a stationary arcuate member could be substituted therefor. Pin 16 could comprise a second roller. It may be possible to practice the present invention be eliminating the vertically-oriented first detent member support plate 12 and to mount the first detent member directly upon the carriage. Such detent member could conceivably comprise a projection from the side of the carriage, which could be an intregal part of the carriage itself. In the commercial embodiment of the invention, movement of the carriage produced movement of the font disc rather than a track select mirror, but this fact is not significant with respect to the invention.

What is claimed is:

1. In a phototypesetter having a machine frame:

a. an elongated way member;

b. a moveable carriage having a carriage support means for supporting said moveable carriage with respect to said way member and for facilitating a lateral shift of said moveable carriage between a first carriage position and a second carriage position;

c. first detent member support means coupled to said moveable carriage for supporting a first detent member thereon;

d. a second detent member coupled to said machine frame for coacting with said first detent member; and e. spring means for mechanically biasing said first and second detent members against each other and simultaneously mechanically biasing said carriage support means against said way member.

2. The combination as set forth in claim 1 wherein said first detent member is configured to be maintained in contact with said second detent member upon the translation of said moveable carriage between said first carriage position and said second carriage position.

3. The combination as set forth in claim 1 wherein at least one of said detent members comprises a roller means for providing roller detent action with the other detent member.

4. The combination as set forth in claim 2 wherein at least one of said detent members comprises roller means for providing roller detent action with the other detent member.

5. The combination as set forth in claim 3 wherein said first detent member comprises roller means coupled to said carriage.

6. The combination as set forth in claim 4 wherein said first detent member comprises roller means coupled to said carriage.

7. In a phototypesetter having a machine frame:

a. an elongated way member;

b. a moveable carriage having carriage support means for supporting said moveable carriage with respect to said way member and for facilitating a lateral shift of said moveable carriage between a first carriage position and a second carriage position;

c. first detent member support means coupled to said moveable carriage for supporting a first detent member thereon;

d. second elongated detent member support means for supporting a second detent member centrally located thereon and pivotably mounted to said machine frame at a first non-centrally located portion thereof; and e. spring means coupled between a second non-centrally located portion of said second detent member support means and said machine frame for mechanically biasing said second detent member against said first detent member and thus for simultaneously causing said carriage support means to be pressed against said way member owing to said biasing.

8. The combination as set forth in claim 7 wherein at least one of said detent members comprises a roller means for providing roller detent action with the other detent member.

9. The combination as set forth in claim 8 wherein said first detent member comprises roller means coupled to said carriage.

10. The combination as set forth in claim 8 wherein said second detent member comprises a pin.

11. The combination as set forth in claim 9 wherein said second detent member comprises a pin.

* * * * *